United States Patent [19]

Thomas

[11] Patent Number: 4,867,496

[45] Date of Patent: Sep. 19, 1989

[54] ELECTRICALLY OPERABLE STRIKE

[75] Inventor: Jay J. Thomas, Forest Hills, N.Y.

[73] Assignee: Trine Products Corporation, Bronx, N.Y.

[21] Appl. No.: 167,333

[22] Filed: Mar. 14, 1988

[51] Int. Cl.[4] ..... E05B 47/00

[52] U.S. Cl. ..... 292/341.16; 292/252; 292/DIG. 66; 292/341.18

[58] Field of Search ..... 292/252, 341.15, 341.18, 292/341.16, DIG. 66

[56] References Cited

U.S. PATENT DOCUMENTS

| | | | |
|---|---|---|---|
| Re. 30,263 | 4/1980 | Horvath | 292/341.16 |
| 1,551,687 | 9/1925 | Peelle . | |
| 2,592,274 | 4/1952 | Groeger | 292/341.18 X |
| 3,094,199 | 6/1963 | Wallmann | 189/46 |
| 3,325,941 | 6/1967 | Prucha | 49/7 |
| 3,361,466 | 1/1968 | Russell et al. | 292/341.18 |
| 3,390,909 | 7/1968 | Nagel | 292/201 |
| 3,705,739 | 12/1972 | Adler | 292/92 |
| 3,811,717 | 5/1974 | Floyd et al. | 292/92 |
| 3,910,617 | 10/1975 | Scalza et al. | 292/144 |
| 4,007,954 | 2/1977 | Erickson | 292/92 |
| 4,012,066 | 3/1977 | Salvatore | 292/38 |
| 4,015,869 | 4/1977 | Horvath | 292/DIG. 66 |
| 4,056,277 | 11/1977 | Gamus et al. | 292/341.16 |
| 4,161,804 | 7/1979 | D'Hooge et al. | 292/144 |
| 4,183,565 | 1/1980 | Allemann | 292/163 |
| 4,437,693 | 3/1984 | Godec | 292/191 |
| 4,471,983 | 9/1984 | Bischoff et al. | 292/341.16 |

*Primary Examiner*—Richard E. Moore

*Attorney, Agent, or Firm*—Brooks Haidt Haffner & Delahunty

[57] ABSTRACT

A fire rated electrically operable strike in which a pivotable keeper is prevented from pivoting by a locking member which is spring biassed into a position in which pivoting of the keeper is prevented until the locking member is moved from its normal, locking position by the electrical energization of a solenoid which actuates an armature connected to the locking member. The locking member has a recess into which a spring biassed ball extends when the locking member is in its locking position. The materials from which the ball and its mounting are made and the relative dimensions thereof are selected so that when the temperature to which the strike is subjected is greater than normal, such as by reason of a fire, but less than a temperature at which the locking member biassing spring is ineffective, the ball expands and the mounting for the ball changes size so that the ball cannot retract from the recess in the locking member, and the locking member is held in its keeper locking position.

13 Claims, 5 Drawing Sheets

1
2
3
4
5
5
5
6
13

30
9
33
8b
8
8a
34
38
37
12
36
31
11
2
28

7
18
22
16
20
7b
7a
17
21
9
15
36
19

ELECTRICALLY OPERABLE STRIKE

The invention relates to an electrically operable strike used to prevent the opening of an associated access obstructing member, such as a door.

Electrically operable strikes are well known in the art, and for example, they are used in connection with the main access door of an apartment building to prevent entry into the building until a solenoid associated with the strike is electrically energized to permit pivoting of the strike keeper. Normally, the strike is energized by means of a circuit completing switch remote from the strike.

The solenoid comprises a winding of a conductor which, when electrically energized, actuates a centrally disposed armature which has a locking member connected thereto and biassed by a spring so that the locking member prevents pivoting of the locking member, and release of the keeper, unless the solenoid is electrically energized. However, to keep the energizing current low, the biassing spring usually has a force which is only slightly more than the force required to return the locking member and the armature to their locking positions. In the event that the strike is subjected to high temperatures, such as by reason of fire, the biassing means weakens and does not provide a force which is sufficient to maintain the locking member and the armature in their locking positions which permits unauthorized entry into the opening protected by the strike and the associated opening obstructing member.

In order to pass the Underwriters Laboratories requirements for a strike rated to remain locked under engulfment by fire, the keeper must remain locked up to temperatures of at least 1925° F. While it is possible to select metals for most of the parts of the strike which will withstand such a temperature, return or biassing springs lose their return or biassing force at much lower temperatures, and therefore, biassing springs are not adequate to retain the keeper in its locked position at the temperature requirements of the Underwriters Laboratories.

In addition, the relationship of the keeper with respect to a latch on a door, can vary with various installations.

Also, for appearance purposes, it is often desirable to make the keeper, which is visible upon opening of a door, of a metal differing from the less expensive other parts of the strike.

It is known in the art to keep a keeper in, or to cause a keeper to move to, its locking position when the latch is subjected to high temperatures by the use of a material which will melt at such high temperature. See, for example, U.S. Pat. No. Re. 30,263 and patents cited thereagainst. Since the keeper must resist relatively high forces, the application of the restraining force by a pin or other means is not practical without a relatively large pin. Furthermore, the use of a meltable material can cause problems with reproductibility of release at a given temperature.

U.S. Pat. No. 4,056,277 discloses the use of a spring biassed ball engageable with the keeper, but the locking of the keeper with high temperatures is not accomplished. Also, because of the restraining forces which must be applied to the keeper, the ball apparatus disclosed in such patent is not satisfactory.

One object of the invention is to prevent the release of the keeper of an electrically operable strike in the event that the strike is subjected to high temperatures such as those specified by the Underwriters Laboratories.

Another object of the invention is to provide a mounting for the keeper which is adjustable toward and away from the access member of an opening to be protected.

A further object of the invention, is providing a pivotable mounting for the keeper which may be made from a material different from that of the keeper.

In accordance with the preferred embodiment of the invention, the strike includes a thermally responsive detent which engages the locking member which in turn engages the keeper and which prevents the locking member from moving out of its locking position in the event that the strike is subjected to temperatures which disables the normal biassing means for the locking member. The keeper is detachably mounted on a hinge, and the hinge is mounted on a case which is adjustably mounted on a face plate so as to be movable toward and away from the protected opening obstructing member.

Other objects and advantages of the present invention will be apparent from the following detailed description of the presently preferred embodiment thereof, which description should be considered in conjunction with the accompanying drawings in which.

For purposes of illustration, the preferred embodiment of the electrically operable strike of the invention will be described in connection with a pivotable opening obstructing member, such as a door, having a spring biassed, depressible latch, but it will be apparent to those skilled in the art that the strike of the invention has other applications.

Figure 1:
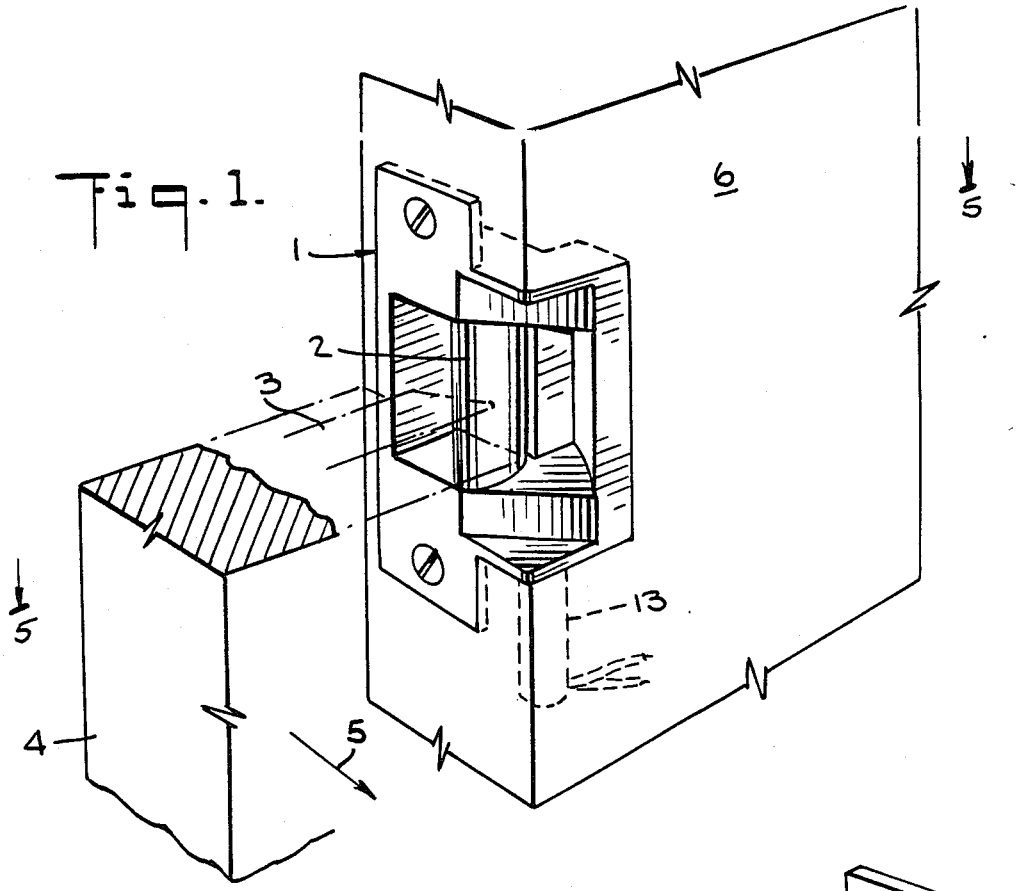
FIG. 1 is a fragmentary, perspective view of the preferred embodiment of the strike of the invention mounted on a member fixed in position in association with a pivotable opening obstructing member having a depressible latch.

As illustrated in FIG. 1, the strike 1 is mounted on a doorway frame 6 in a recessed manner, and has a keeper 2 which is engageable with a latch 3 mounted on a pivotable door 4. The latch 3 is normally biassed into the position shown in FIG. 1, and when the keeper 2 is locked, as described hereinafter, the keeper 2 prevents pivoting of the door 4 in the direction indicated by the arrow 5. Pivoting of the door 4 in the direction opposite to the direction indicated by the arrow 5 is prevented by a stop (not shown) on the door frame 6. With the keeper 2 in the position shown in FIG. 1, the door 4 can be closed by reason of the sloping edge of the latch 3 which, when it engages the keeper 2, depresses the latch 3 and permits it to ride over the keeper 2 and then, assume the position shown in FIG. 1.

Figure 2:
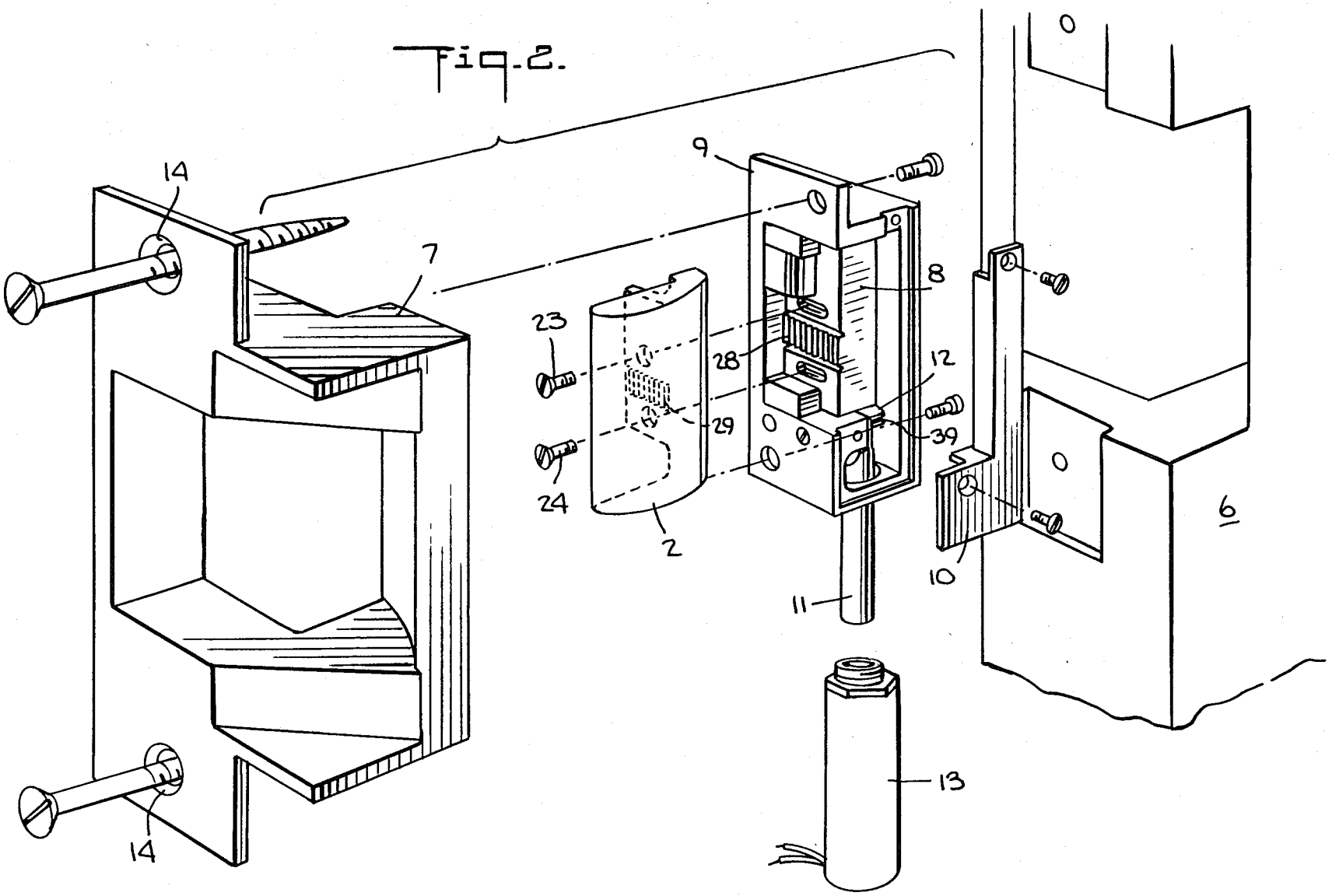
FIG. 2 is an exploded, perspective view of the preferred embodiment of the strike of the invention.

As illustrated in FIG. 2, the preferred embodiment of the strike comprises the keeper 2, a face plate 7, a pivotable hinge member 8, a case 9, a case cover 10, an armature 11 pivotally connected to a locking member 12, and a solenoid 13 for moving the armature 11 in the downward direction as viewed in FIG. 2.

Figure 3:
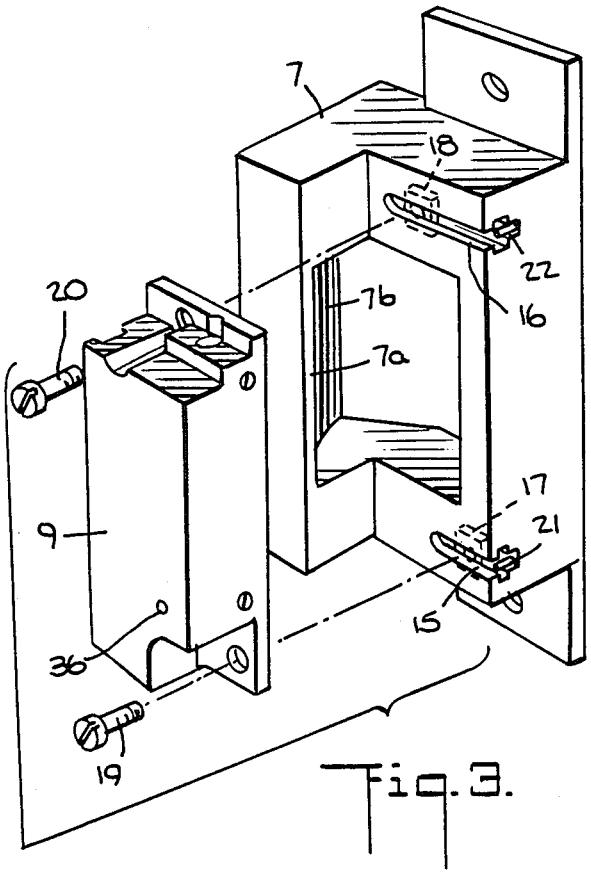
FIG. 3 is an exploded perspective view of the strike face plate and the case for the keeper hinge member.

The front face of the face plate 7 is seen in FIG. 2, and the rear face of the face plate 7, in association with the case 9 is visible in FIG. 3. The face plate 7 can be a single piece casting of metal and requires machining of only the mounting holes 14 and if desired, polishing of only the front face thereof. The rear of the face plate 7 has a pair of T-shaped slots 15 and 16 for slidably receiving nuts 17 and 18 which engage screws 19 and 20 for securing the case 9 to the face plate 7. If desired, the nuts 17 and 18 can be retained in the slots 15 and 16 by pins 21 and 22 which are pressed into holes on the face plate 7.

Since, as described hereinafter, the keeper 2 is mounted on the case 9, it will be apparent that the keeper 2 can by means of the slots 15 and 16 and the screws 19 and 20 and the nuts 17 and 18, be adjusted toward and away from the edge 7*a* of the wall 7*b* of the face plate 7 to accommodate latches 3 of different sizes and the position of the door 4 when the latter is closed.

Figure 4:
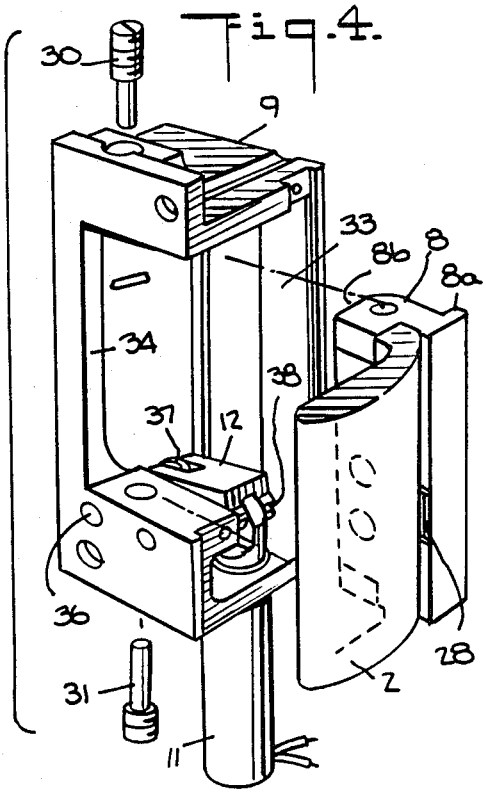
FIG. 4 is a partially exploded perspective view of the keeper, the keeper hinge member, the lock member and the case shown in FIG. 3.
Figure 7:
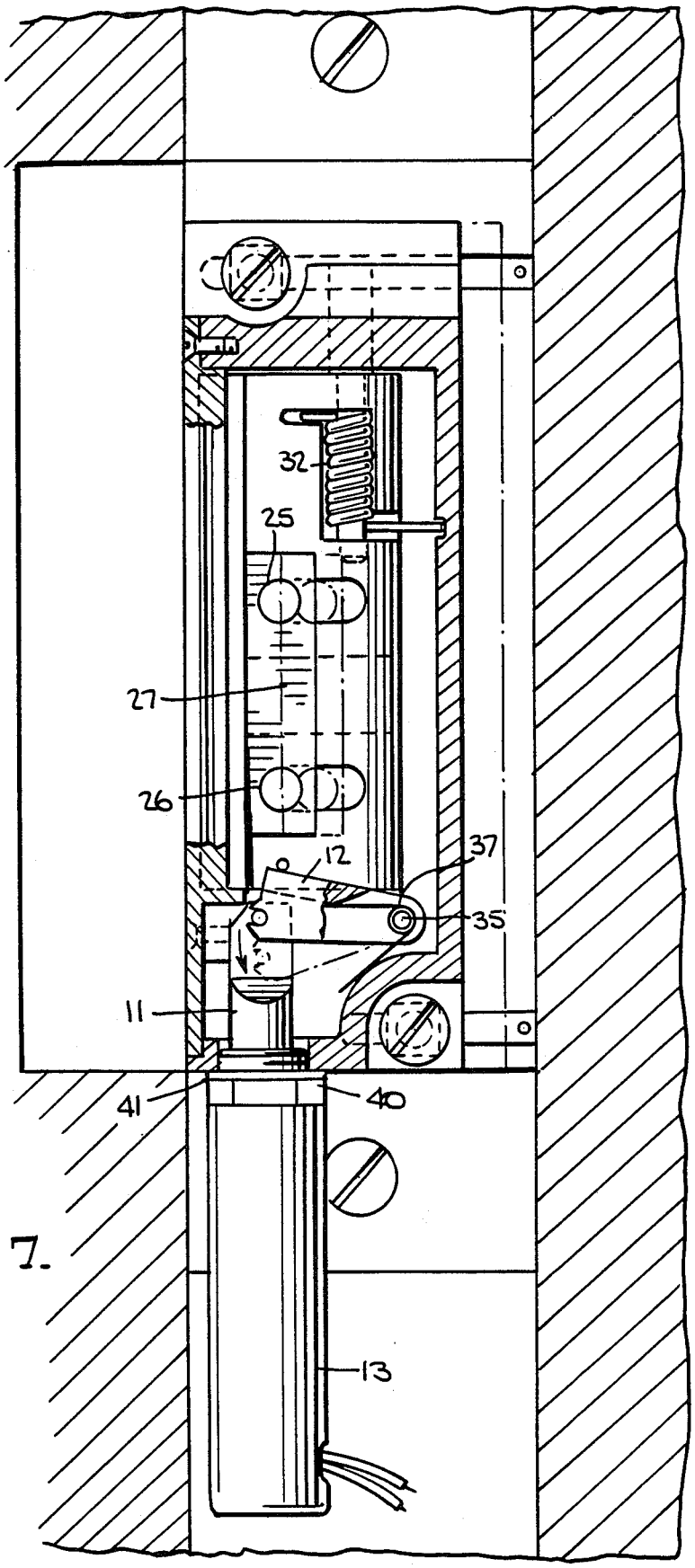
FIG. 7 is a front elevation view, partly in cross-section, of the preferred embodiment of the strike of the invention and is taken along the line 7—7 identified in FIG. 5.

As illustrated in FIGS. 2, 4 and 7, the keeper 2 is mounted on a hinge member 8 and is secured thereto by screws 23 and 24 which pass through holes in the keeper 2 and the hinge member 8 and are received in threaded holes 25 and 26 in a plate 27. To increase the resistance to movement of the keeper 2 with respect to the hinge member 8, the keeper 2 and the hinge member 8 are provided with interengaging serrated or toothed surfaces 28 and 29 (FIGS. 2 and 4).

Figure 5:
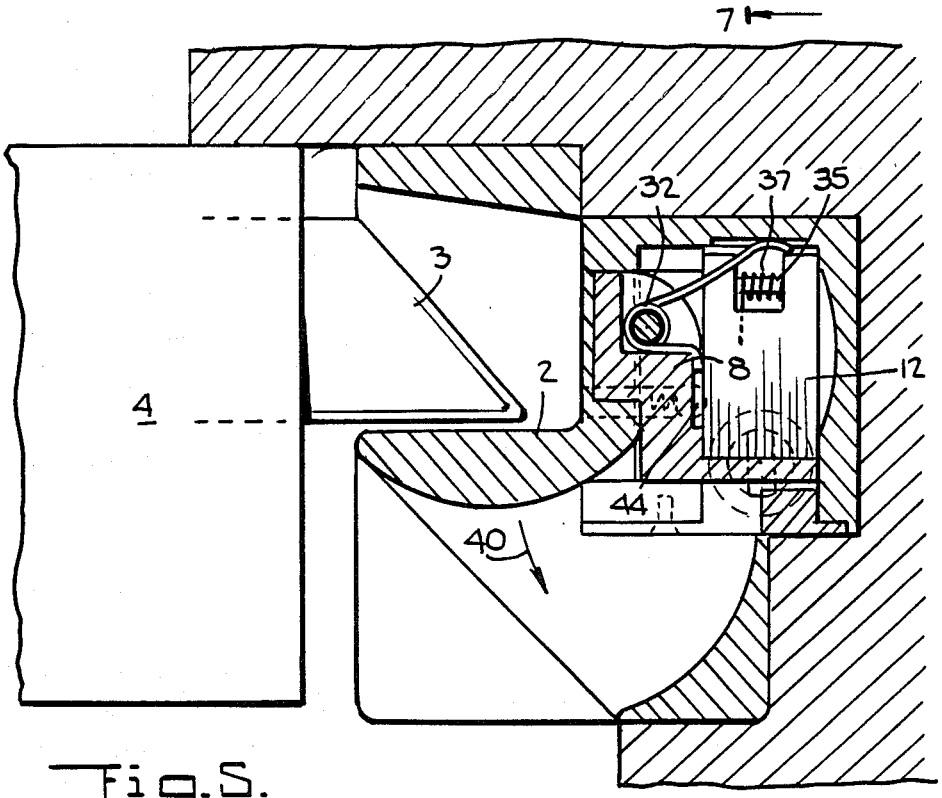
FIG. 5 is a plan view, partially in cross-section, of the preferred embodiment of the strike in its locked position and in association with the latch of an opening obstructing member and is taken along the line 5—5 identified in FIG. 1.
Figure 6:
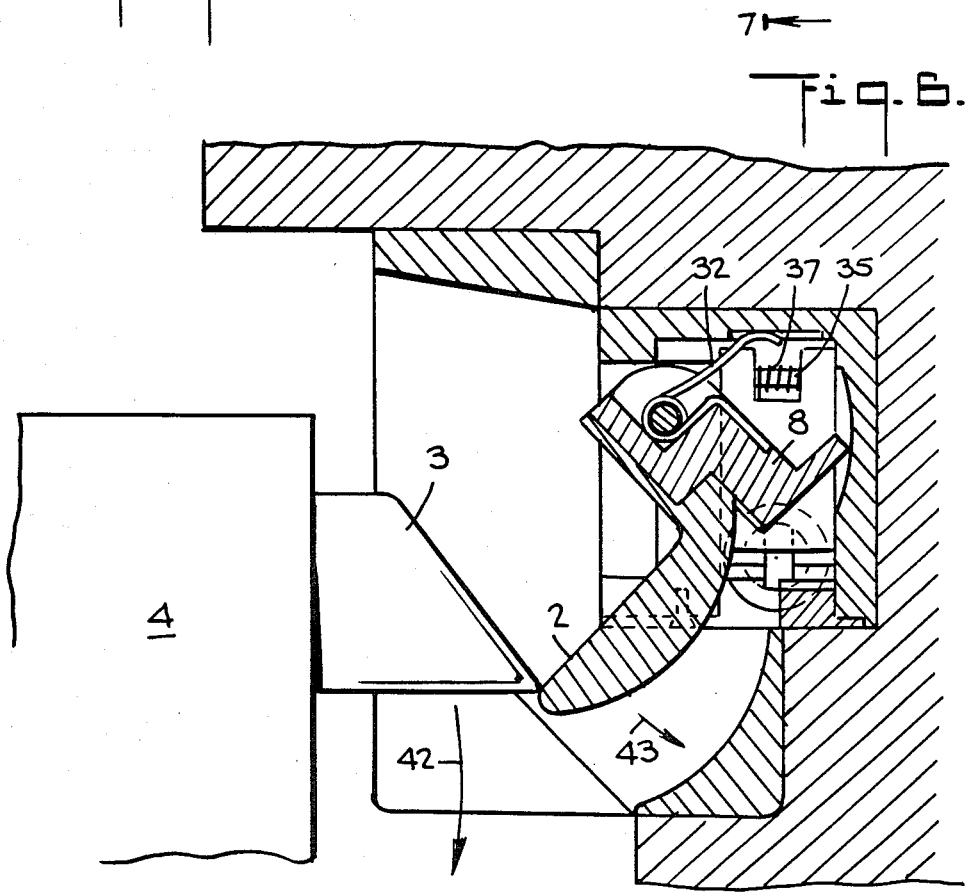
FIG. 6 is similar to FIG. 5 illustrating the keeper and its associated parts in their released positions.

The hinge member 8 is pivotally mounted in the case 9 by a pair of partially threaded pins 30 and 31 which are received in threaded holes in the case 9. The hinge member 8 is urged into the position shown in FIGS. 1 and 6 by a spring 32 (FIGS. 5–7). Pivoting of the keeper 2 away from a latch, e.g. the latch 3, is limited by engagement of an extension 8*a* (FIG. 4) on the hinge member 8 with a wall 33 of the case 9. Pivoting of the keeper 2 toward the latch is limited by engagement of the face 8*b* of the hinge member 8 with the wall 34 of the case 9. Since the case 9 and the hinge member 8 are effectively concealed from view by the face plate 7 and the keeper 2, respectively, the appearance thereof, after casting, need not be improved, such as by polishing, and the metal thereof need not be the same as the metal of the face plate 7 and the keeper 2 although, if desired, they may all be made of the same metal.

The locking member 12 is also pivotally mounted on the case 9 by a pin 35 (FIGS. 5–7) which is received in holes 36 (FIGS. 3 and 4) in the case 9. The locking member 12, is biassed into the position shown in FIGS. 4, 5 and 7, the keeper locking position, by a relatively light spring 37 which, preferably, provides a force, at normal operating temperatures, which is no more than necessary to assure that the locking member 12 will be returned to its locking position, in the absence of energization of the solenoid 13, against the weight of the locking member 12 and the armature 11 and the friction involved. The armature 11 carries a pin 38 which fits into a groove 39 at the end of the locking member 12 remote from its pivot axis so as to pivotally interconnect the armature 11 and the locking member 12. Upward movement of the locking member 12 is limited by engagement of the opposite end thereof with a wall of the case 9 and downward movement thereof is limited by the armature 11.

The upper end of the case of the solenoid 13 is threaded and engages threads in the wall of the case 9. A lock nut 40 and a lock washer 41 (FIG. 7) are intended to prevent loosening of the case of the solenoid 13 with respect to the case 9.

FIG. 5 illustrates the positions of the parts with the door 4 closed and the latch 3 intermediate a wall of the face plate 7 and the keeper 2. As long as the solenoid 13 is not energized, the locking member 12 is disposed in the path of pivotal movement of the keeper 2 and prevents movement of the keeper 2 in the direction of the arrow 42. Thus, the door 4 is prevented from being opened.

When the solenoid 13 is energized, the armature 11 is pulled downwardly which causes the locking member 12 to pivot into a position in which it is out of the path of pivotal movement of the keeper 2. Thus, as shown in FIG. 6, opening of the door 4, in the direction of the arrow 42 is no longer prevented, the engagement of the latch 3 with the keeper 2 causing the latter to pivot in the direction of the arrow 43 against the force of the spring 32. After the latch 3 passes by the keeper 2, the keeper 2 is returned to the position shown in FIG. 5 by the spring 32. When the solenoid 13 is de-energized and the keeper 2 returns to the position shown in FIG. 5, the locking member 12 is returned by the spring 37 to its position in which it again prevents pivotal movement of the keeper 2.

Normally, the strike 1 is mounted with the solenoid 13 and the armature 11 vertically below the keeper 2 and the locking member 12, as illustrated in FIGS. 1, 2, 4 and 7, for space reasons. Therefore, the biassing means or spring 37 for returning the locking member 12 to its locking position must have sufficient force to overcome the weight of the locking member 12 and the armature 11 and the friction involved. However, excessive biassing force cannot be used because the size of the solenoid 13 and the energizing current therefor must be kept as small as possible. With normal conditions of the parts, a spring 37 can apply a relatively light force, and therefore, the solenoid 13 and its energizing current may be kept small. However, with abnormal temperature conditions, such as a fire, the spring 37 will weaken to the point where the weight of the locking member 12 and the armature 11 will cause the locking member 12 to pivot into its unlocking position which means that the keeper 2 would be free to pivot thereby unlocking the door 4. The problem cannot be overcome by the use of a stronger spring both because even a stronger spring will weaken with heat and because, for the reasons set forth hereinbefore, a stronger spring is undesirable.

Figure 8:
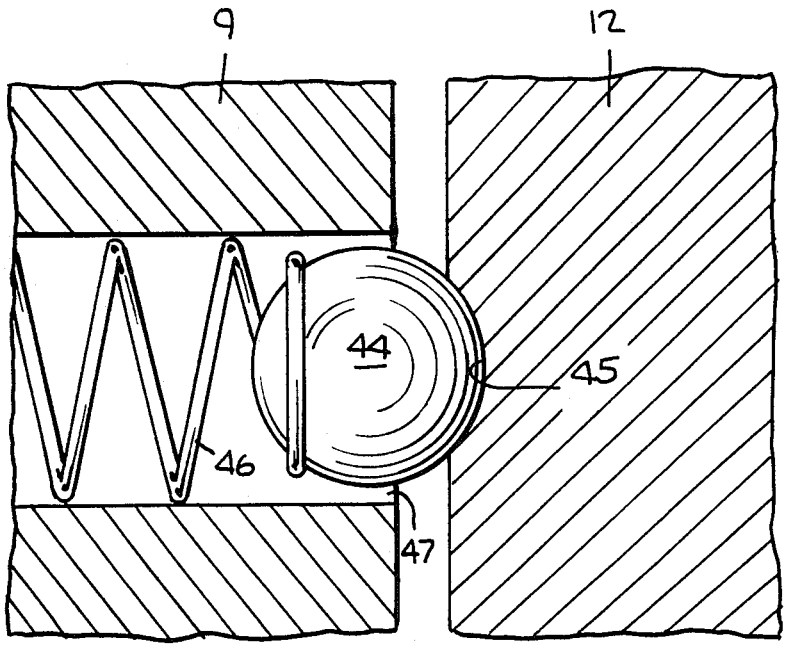
FIG. 8 is an enlarged, fragmentary, cross-sectional view of the detent in association with the keeper locking member.

In accordance with the invention, pivoting of the locking member 12 out of its locking position when the strike is subjected to high temperatures which destroy the effectiveness of the spring 37 to hold the locking member 12 in its locking position is prevented by thermally responsive detent means which locks the locking member 12 in its locking position before the spring 37 loses its effectiveness. In the preferred embodiment of the invention, the thermally responsive detent means comprises a metal ball 44 which is normally biassed into a recess or dimple 45 in the locking member 12 by a spring 46 having a relatively light force (FIGS. 5 and 8). Such a detent means is preferred because of its simplicity and because, at normal temperatures, it does not significantly increase the resistance to pivoting the locking member 12 when the solenoid 13 is energized. However, it will be apparent to those skilled in the art that other detent means which is temperature responsive and which prevents pivoting of the locking member 12 when the temperature to which the strike is subjected exceeds a predetermined value, such as a temperature above 900° F. and below the temperature at which the spring 37 is no longer effective.

The diameter and metal of the ball 44 are selected in relation to the diameter of the opening 47 in the case 9 and the metal of the case 9 so that when the strike is subjected to heat and the temperature thereof reaches a predetermined value, the diameter of the opening 47 decreases and the diameter of the ball 44 increases by amounts which cause the wall of the opening 47 and the surface of the ball 44 to frictionally engage sufficiently to prevent movement of the ball 44 out of the dimple 45, e.g. to prevent movement of the ball 44 from the position shown in FIG. 8. With the ball 44 held in the dimple 45, the locking member 12 cannot pivot out of its locking position.

Of course, prior to the interengagement of the wall of the opening 47 and the ball 44, the ball 44 is permitted to move out of the dimple 45 by compressing the spring 46, the biassing force of the latter merely being sufficient to move the ball 44 into the dimple 45 when the locking member 12 is in its locking position.

The parts of the strike 1 including the ball 44 but excluding the springs 32, 37 and 46, the solenoid 13 and optionally, the armature 11, are made of a metal, such as stainless steel, which is not destroyed or rendered ineffective at the temperature to which they will be subjected during a fire, e.g. 1925° F. One satisfactory metal for such parts is 303 and 416 stainless steel.

One satisfactory combination of metals for the case 9 and the ball 44 and of sizes for the ball 44, the opening 47 and the dimple 45 is as follows:

| | |
|---|---|
| Case 9 metal | 303 cast stainless steel |
| Opening 47 diameter | 0.126 + 0.000 in. − 0.0003 |
| Ball 44 diameter | 0.125 + 0.000 in. − 0.0005 |
| Ball 44 metal | 303 stainless steel |
| Dimple depth | 0.020 in. |
| Dimple spherical radius | 0.0625 in. |

While the ball 44 is spherical and the dimple or recess 45 is spherical in the preferred embodiment, it will be apparent that the ball 44 may be replaced by a segment of a sphere with its radii in a plane substantially perpendicular to the pivoting direction of the portion of the locking member 12 engaged by such segment and the recess 45 may be a segment of a sphere with its radii in the same plane.

Also, although a specific example has been given, other materials and relative dimensions may be selected to provide a seizure or sticking of the detent member when the temperature to which the strike is subjected exceeds a value less than the temperature at which the return spring for the locking member 12 becomes ineffective.

Although the theory of operation of the detent means is that it will become effective to prevent movement of the locking member before the biassing means therefor is ineffective, it will be apparent that the detent means provides additional protection against release of the keeper even if the biassing means for the locking member remains effective at temperatures above the temperature at which the detent means locks up and hence, above the temperature rating of the strike.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. In an electrically operable strike comprising a keeper movable from a first, locked position to a second release position, a locking member movable from a first position in which it prevents movement of said keeper from its said first position to a second position in which said keeper is permitted to move into its said second position and electrically energizable solenoid means connected to said locking member for moving said locking member from its said first position to its said second position, the improvement comprising thermally responsive detent means actuated when the temperature exceeds 600° F., said detent means engaging said locking member at least upon actuation and preventing movement of said locking member from its said first position to its said second position.

2. An electrically operable strike as set forth in claim 1 wherein said locking member is biassed into its said first position by biassing means which is temperature sensitive and ineffective to maintain said locking member in its said first position at a temperature above 600° F.

3. An electrically operable strike as set forth in claim 1 wherein said thermally responsive detent means comprises a thermally expansible ball mounted in an opening in a fixed portion of said strike and engageable with said locking member, the dimensions of said ball and said opening and the materials of said ball and said fixed portion of said strike being selected so that said ball engages the wall of said opening at temperatures above 600° F. and prevent movement of said ball in said opening away from said locking member.

4. An electrically operable strike as set forth in claim 3 wherein said locking member has a recess therein and said ball is movably biassed into said recess at temperatures between room temperature and 600° F.

5. An electrically operable strike as set forth in claim 4 wherein said keeper is pivotally mounted and has a predetermined path of movement from its said first position to its said second position, said locking member is pivotally mounted and in its said first position is in said path of movement of said keeper and in its said second position is out of said path of movement and wherein said locking member is biassed into its said first position by elastic means.

6. In an electrically operable strike comprising a keeper movable from a first, locked position to a second, release position, a locking member movable from a first position in which it prevents movement of said keeper from its said first position to a second position in which said keeper is permitted to move into its said second position, a face plate and electrically energizable solenoid means connected to said locking member for moving said locking member from its said first position to its said second position, the improvement comprising a case adjustably mounted on said face plate for movement toward and away from the face of said face plate and wherein said keeper and said locking member are movably mounted on said case.

7. An electrically operable strike as set forth in claim 6 wherein said keeper is pivotally mounted on said case, the pivot axis of said keeper being substantially parallel to the direction of movement of said case.

8. An electrically operable strike as set forth in claim 7 wherein said keeper is detachably mounted on a hinge member pivotally mounted on said case.

9. An electrically operable strike as set forth in claim 8 wherein said locking member is also pivotally mounted on said case, the pivot axis of said locking member extending transversely to said pivot axis of said keeper.

10. An electrically operable strike as set forth in claim 9 further comprising thermally responsive detent means actuable at a temperature above 600° F. for preventing movement of said locking member from its said first position to its said second position.

11. An electrically operable strike as set forth in claim 10 wherein said locking member is biassed into its said first position by biassing means which is temperature sensitive and ineffective to maintain said locking member in its said first position at a temperature above 600° F.

12. An electrically operable strike as set forth in claim 11 wherein said thermally responsive detent means comprises a thermally expansible ball mounted in an opening in said case and engageable with said locking member, the dimensions of said ball and said opening and the materials of said ball and said fixed portion of said strike being selected so that said ball engages the wall of said opening at temperatures above 600° F. and prevents movement of said ball in said opening away from said locking member.

13. An electrically operable strike as set forth in claim 12 wherein said locking member has a recess therein and said ball is normally biassed into said recess at temperatures between room temperature and 600° F.

* * * * *

UNITED STATES PATENT AND TRADEMARK OFFICE

CERTIFICATE OF CORRECTION

PATENT NO. : 4,867,496

DATED : September 19, 1989

INVENTOR(S) : Jay J. Thomes

It is certified that error appears in the above-identified patent and that said Letters Patent is hereby corrected as shown below:

ON THE TITLE PAGE

Item [19] "Thomes" should read --Thomes--.

Item [75] "Jay J. Thomas" should read --Jay J. Thomes--.

Signed and Sealed this

Eleventh Day of February, 1992

*Attest:*

HARRY F. MANBECK, JR.

*Attesting Officer*

*Commissioner of Patents and Trademarks*